United States Patent [19]

Betts

[11] 4,380,958

[45] Apr. 26, 1983

[54] ELECTROSTATIC SAFE ELECTRIC MATCH

[75] Inventor: Robert E. Betts, Huntsville, Ala.

[73] Assignee: The United States of America as represented by the Secretary of the Army, Washington, D.C.

[21] Appl. No.: 217,349

[22] Filed: Dec. 17, 1980

[51] Int. Cl.[3] ..... F42B 3/18

[52] U.S. Cl. ..... 102/202.2; 102/202.11

[58] Field of Search ..... 102/202.1, 202.2, 202.3, 102/202.11

[56] References Cited

U.S. PATENT DOCUMENTS

| | | | |
|---|---|---|---|
| 2,478,838 | 8/1949 | Rolland | 102/202.11 |
| 2,741,179 | 4/1956 | Taylor et al. | 102/202.11 |
| 2,995,086 | 8/1961 | Scott | 102/202.11 |
| 3,415,189 | 12/1968 | Trevorrow | 102/202.11 |
| 3,610,153 | 10/1971 | Betts et al. | 102/70.2 A |
| 3,717,096 | 2/1973 | Ward | 102/202.11 |
| 3,930,449 | 1/1976 | Buchele | 102/70.2 R |
| 4,152,988 | 5/1979 | Haas et al. | 102/202.11 |

*Primary Examiner*—Charles T. Jordan

*Attorney, Agent, or Firm*—Nathan Edelberg; Robert P. Gibson; Freddie M. Bush

[57] ABSTRACT

A safe electroexplosive device such as an electric match is provided by covering the existing electric match with a coating that prevents electrostatic discharge penetration of the coating. The coating may be either an inner insulator with a conductive outer layer or it may be just a conductive layer over the match. Use of the insulator coating allows an open-circuit terminal to remain once the device is initiated by its power source. Use of only the conductive coat requires the coat to have a resistance greater than the match bridgewire circuit resistance and leaves a low resistance path across the power source after the device has been fired.

6 Claims, 2 Drawing Figures

ELECTROSTATIC SAFE ELECTRIC MATCH

DEDICATORY CLAUSE

The invention described herein may be manufactured, used, and licensed by or for the Government for governmental purposes without the payment to me of any royalty thereon.

BACKGROUND OF THE INVENTION

Electric matches are electroexplosive devices which are simple in design and least expensive of the electroexplosive devices. The electric match is adapted to receive an electrical impulse across two leads which causes a bridge wire at the lead ends to heat and ignite a pyrotechnic or other material. A disadvantage of electric matches is susceptibility to accidental initiation from electrostatic discharges. Ignition or initiation of electroexplosive devices (EED) by an electrostatic discharge (ESD) may occur by either one of two basic modes—either through the bridge wire circuit or through the explosive mix surrounding the bridgewire. By simply having the bridgewire of a sufficient mass and electrical characteristic to absorb electrostatic electrical energy to a level where the bridgewire temperature is maintained below the ignition temperature of the explosive mixture, the electric match can readily be made safe from electrostatic discharge occuring through the bridgewire. The explosive mixture or pyrotechnic material susceptibility to electrostatic discharge is independent of the bridgewire. The degree of safety from electrostatic discharge is dependent on the susceptibility of the particular explosive mixture.

SUMMARY OF THE INVENTION

An electroexplosive device such as an electric match is made safe from electrostatic discharge initiation of the device by coating the device to prevent electrostatic penetration of the coating. The coating may be either an insulator with an outer conductive layer which leaves an open circuit after desired initiation of the device, or a resistive, conductive coating with no insulator for leaving the device with a resistance across the terminals after initiation.

DESCRIPTION OF THE PREFERRED EMBODIMENT

An electric match or electroexplosive device can be made safe from inadvertent initiation in an electrostatic discharge environment byassuring that any electrostatic discharge spark occurs and remains external to the explosive mixture of the EED. Construction of EED matches is well established and may be made by any present manufacturing methods. However, after the match construction is completed it may be made safe to electrostatic discharge initiation of the pyrotechnic by coating the match with a suitable compound for preventing electrostatic penetration of the device.

Figure 2:
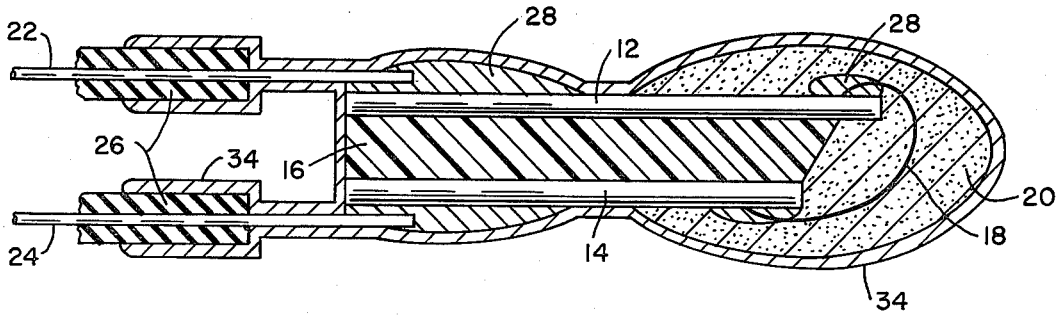
FIG. 2 is a diagrammatic, sectional view of an electric match with a conductive coating thereover.
Figure 1:
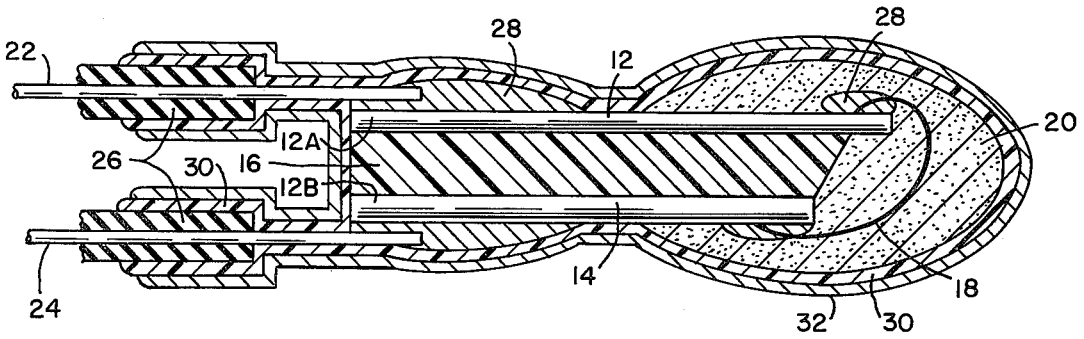
FIG. 1 is a diagrammatic, sectional view of an electric match with insulation and static conductor coating.

Referring now to the drawings wherein like numbers refer to like parts, preferred embodiments of the electrostatic discharge safe electric match are shown in FIGS. 1 and 2. The basic electric match includes a pair of conductive plates or bridge posts 12 and 14 separated by an insulator 16 and having a bridge wire 18 coupled therebetween. An explosive mixture or pyrotechnic composition 20 covers the bridgewire end of the assembly and surrounds the bridgewire between the posts. Lead wires 22 and 24 are attached to respective ends 12A and 12B of the bridgeposts for supplying an electric potential thereto when the device is to be initiated. Wires 22 and 24 are covered with insulation 26. Typically, the wires 18, 22, and 24 are attached to the bridgeposts by solder, welding or other means and the post ends with bridgewire attached is dipped into a pyrotechnic slurry and removed for curing or setting of the dip.

After construction of the basic electric match, the match can now be made safe from electrostatic discharge by placing either insulating, conductive, or both materials over the match and including a portion of the wire insulation 26 to assure coverage. As shown in FIG. 1, a coating 30 completely encompasses the match, sealing the match from the external environment and providing electrical insulation to the previously exposed solder and wires 22 and 24. Insulation coat 30 may be applied simply and economically by dipping the match into a coating material and removal for drying, or alternatively by spraying or other means. Similarly, an outer coat of conductive material 32 is placed over insulation 30 for encompassing the match with a static conductor.

FIG. 2 discloses the basic match with only a static conductive coat placed thereover. In this embodiment the coat 34 actually makes electrical contact with exposed portions of wires 22 and 24 and solder 28. Inherent resistance of conductive coat 34 must be sufficient to assure that desired electrical discharge currents supplied to leads 22 and 24 are sufficient to heat wire 18. The resistance of conductive coat 34, when measured between the lead wires is approximately 10 times the bridgewire resistance (as a minimum) and may be even as high as 1 megohm, as a maximum. Thus, for a bridgewire resistance of 1 ohm, the coat 34 may vary from approximately 10 ohms to 1 megohm. The arrangement of the coats of FIGS. 1 and 2 restricts the path for an electrostatic spark to the uniform surface conductor external to the explosive material, thereby preventing inadvertent operation of the device due to electrostatic discharges.

In the device of FIG. 1, the insulation dip coat completely covers the explosive mixture and exposed electrical leads. Care is taken to assure adequate insulation coverage so that the subsequent conductive coating does not contact the EED bridge posts and inadvertently establish a conductive path between contacts. This insulator jacket construction allows the EED to remain attached to its power source in an open or unshorted state after it has been properly functioned by the power source. Thus where the power supply for the EED is also used for other circuit operation, there is no residual short-circuit of the power source by the remaining components of the match.

If post-fire shorting between the bridge posts is not a problem in the system the electric match can be made safe with the high resistance coating 34 of FIG. 2. Although the leads are electrically connected by coating 34, the resistance of the coat is considerably higher than the lead conductors, bridgeposts, and bridgewire. Thus a desired initiation pulse of electrical energy input will follow the path of least resistance through bridgewire 18 and ignite the pyrotechnic. This resistance coat 34 can be as low as but at least 10 times greater than the normal squib circuit resistance. Thus, for a squib circuit or electric match resistance of 1 ohm, the resistance coat need only provide 10 ohms of resistance between bridgeposts.

Typical material which can provide insulating coats include epoxies, varnishes, lacquers, acrylics, and Glyptal. Glyptal is a registered trademark of General Electric Company for synthetic resins and paints. Typical material which can provide conductive coats of varying resistance include silver paint, metal suspension paint, graphite, silver dust, and Aquadag. Aquadag is a colloidal solution of graphite in water, and is a registered trademark of the Achison Colloids Company.

Although a particular embodiment and form of the invention has been illustrated, it will be apparent to those skilled in the art that modification may be made without departing from the scope and spirit of the foregoing disclosure. Therefore it should be understood that the invention is limited only by the claims appended hereto.

I claim:

1. A safe electroexplosive device comprising: an electric match, coating means covering the surface of said match for providing a restrictive shield to electrical discharges external to said match, said coating means comprising an electrically conductive medium encompassing said match.

2. A safe electroexplosive device as set forth in claim 1 wherein said electrically conductive coating has an inherent resistance to electrical current flow, said resistance being greater than the electrical resistance of the initiating current carrying portions of said electric match.

3. A safe electroexplosive device as set forth in claim 2 wherein said conductive coating is in direct contact with and covers all surface portions of said electric match which are adapted for conveying electric currents and in contact with portions which comprise pyrotechnic or explosive mixtures for providing an electrostatic shield therefor, said resistance of the conductive coating being at least 10 times that of the electric match.

4. A safe electroexplosive device as set forth in claim 1 wherein said coating means further comprises an insulating material disposed between said conductive medium and said electric match.

5. A safe electroexplosive device as set forth in claim 4 wherein said insulating material encompasses all exposed surface portions of said electric match, preventing contact of said electric match conductors and pyrotechnic with said conductive medium.

6. A safe electroexplosive device as set forth in claim 5 wherein said conductive medium provides electrostatic shielding of said match.

* * * * *